US005413259A

United States Patent [19]

Cerruti et al.

[11] Patent Number: 5,413,259

[45] Date of Patent: May 9, 1995

[54] DEVICE FOR REPEATED, AUTOMATIC METERING OF DOSES OF A POWDERED DETERGENT IN WATER-CONDUCTING CLEANING MACHINES

[75] Inventors: Daniele Cerruti, Caresana-VC, Italy; Egon Galler-Benker, Offingen, Germany

[73] Assignee: Bosch-Siemens Hausgeraete GmbH, Munich, Germany

[21] Appl. No.: 156,884

[22] Filed: Nov. 23, 1993

[30] Foreign Application Priority Data

Mar. 26, 1992 [IT] Italy ..... TO92A0265

[51] Int. Cl.[6] ..... B67D 5/00

[52] U.S. Cl. ..... 222/636; 68/17 R; 222/361; 222/367

[58] Field of Search ..... 68/17 R, 17 A; 222/651, 222/636, 361, 362, 367, 370, 152, 190; 406/63, 67, 68

[56] References Cited

U.S. PATENT DOCUMENTS

| | | | |
|---|---|---|---|
| 2,793,940 | 5/1957 | Bennett | 68/17 R X |
| 2,816,427 | 12/1957 | Vela . | |
| 3,188,146 | 6/1965 | Cordes . | |
| 3,233,782 | 2/1966 | Ullman, Jr. et al. | 222/636 X |
| 4,528,848 | 7/1985 | Häfner | 222/636 X |
| 5,209,607 | 5/1993 | Wei et al. | 222/636 X |

FOREIGN PATENT DOCUMENTS

| | | | |
|---|---|---|---|
| 0297371 | 1/1989 | European Pat. Off. . | |
| 1585592 | 4/1971 | Germany . | |
| 3730405 | 3/1988 | Germany . | |
| 4134786 | 7/1992 | Germany . | |
| 446630 | 3/1968 | Switzerland . | |
| 1149574 | 4/1969 | United Kingdom . | |
| 1204422 | 9/1970 | United Kingdom . | |
| 520515 | 10/1976 | U.S.S.R. | 222/636 |
| 82/00482 | 2/1982 | WIPO . | |

*Primary Examiner*—Kevin P. Shaver

*Attorney, Agent, or Firm*—Herbert L. Lerner; Laurence A. Greenberg

[57] ABSTRACT

A water-conducting cleaning machine, in particular a household dishwasher or a household washing machine, has a processing vessel. A device for repeated, automatic metering of doses of a powdered detergent includes a detergent holder having an interior and an outlet opening. A metering and dispensing device is associated with a duct, is disposed below the outlet opening and has at least one indentation with an interior for receiving individual doses of a powdered detergent from the outlet opening and for feeding the individual doses to the processing vessel in a dispensing position. A compressed air generator generates a flow of compressed air continuously acting upon the interior of the detergent holder and upon the duct, and acting upon the interior of the indentation in the dispensing position.

12 Claims, 4 Drawing Sheets

DEVICE FOR REPEATED, AUTOMATIC METERING OF DOSES OF A POWDERED DETERGENT IN WATER-CONDUCTING CLEANING MACHINES

CROSS-REFERENCE TO RELATED APPLICATION

This application is a Continuation of International Application Serial No. PCT/EP93/00450, filed Feb. 26, 1993.

BACKGROUND OF THE INVENTION

1. Field of the Invention

The invention relates to a device for repeated, automatic metering of doses of a powdered cleaning agent or detergent in water-conducting or carrying cleaning machines, in particular household dishwashers and household washing machines, including a detergent holder with an outlet opening above a metering and dispensing device being equipped with at least one indentation for receiving individual doses of a powdered detergent that are fed into a processing vessel of the water-conducting cleaning machine.

In known water-conducting cleaning machines, in which powdered detergent is dispensed for the cleaning process, particularly in household dishwashers or washing machines, a detergent holder is filled manually by the user before each cleaning operation. Due to the many manipulations the user must make, such a filling process is inconvenient. Another disadvantage of the known appliances is that exact metering of the detergent to suit the particular intended use is achievable only with great difficulty. Yet another disadvantage of the known appliances is that when the detergent holder is filled, detergent can spill out of the holder and thus is wasted.

In order to avoid those disadvantages, there is a demand in the market for machines in which the delivery of exact doses of detergent for each cleaning operation is effected automatically and repeatedly, so that optimal cleaning action is achieved while simultaneously lowering energy consumption and the burden on the environment.

Such demands are met in known machines by using large-capacity detergent holders that are capable of automatically and repeatedly supplying exact, predetermined doses of detergent for each cleaning operation. However, the known configurations for automatic, repeated feeding of doses of detergent require complex devices that can only be manufactured industrially at major cost and that are practically never consistently reliable, since the highly hygroscopic powdered detergent undergoes a change as a result of the moisture that penetrates the detergent holder of the dispenser from the processing vessel of the cleaning appliance. The detergent holder, which is disposed in the interior of the cleaning machine, is exposed to moisture which enters through the required existing ejection opening during the cleaning process, so that powdered detergent contained in the detergent holder often clumps together. The result is that the function is impeded, and moreover clumps are difficult to remove from the detergent holder of the dispenser. Clumping of the powdered detergent is a serious disadvantage, which in the worst case can cause a change in the volume of a dispensing chamber or even the complete blockage of the dispenser. Moreover, powdered detergents have a strong scouring action, and the escape of detergents into ducts, bearings and so forth of the dispenser can be effectively prevented only by using complicated and expensive seals.

SUMMARY OF THE INVENTION

It is accordingly an object of the invention to provide a device for repeated, automatic metering of doses of a powdered detergent in water-conducting cleaning machines, in particular household dishwashers and household washing machines, which overcomes the hereinafore-mentioned disadvantages of the heretofore-known devices of this general type and which does so in a simple way.

With the foregoing and other objects in view there is provided, in accordance with the invention, in a water-conducting cleaning machine, in particular a household dishwasher or a household washing machine, having a processing vessel, a device for repeated, automatic metering of doses of a powdered detergent, comprising a detergent holder having an interior and an outlet opening; a duct; a metering and dispensing device being associated with the duct, being disposed below the outlet opening and having at least one indentation with an interior for receiving individual doses of a powdered detergent from the outlet opening and for feeding the individual doses to the processing vessel in a dispensing position; and a compressed air generator generating a flow of compressed air continuously acting upon the interior of the detergent holder and upon the duct, and acting upon the interior of the indentation in the dispensing position.

Through the use of this action upon the interior of the detergent holder and the duct of the metering and dispensing device, it is assured that the internal pressure of the device is always higher than the outside pressure, or in other words the pressure in the processing vessel of the cleaning machine. The entry of moisture into the interior of the device is thus effectively averted. By acting upon the interior of an indentation in the dispensing position, the expulsion of the dose of powder is carried out, and it is assured that the penetration of moisture into the metering and dispensing device, which at the moment of the expulsion of the detergent dose is necessarily intermittently open, is effectively avoided.

In accordance with another feature of the invention, there is provided a dehumidifier connected upstream of the compressed air generator. This provision assures that as a result of the flow of compressed air that acts upon not only the interior of the detergent holder but also the metering and dispensing device, moisture cannot get into the device according to the invention.

In accordance with a further feature of the invention, the detergent holder is funnel-like and has a removable lid that is water-tight with respect to the detergent holder; the metering and dispensing device has at least one indentation; connecting parts are provided for the detergent holder and/or the metering and dispensing device; a compressed air conduit system is connected to the compressed air generator and has connecting parts; and the connecting parts of the detergent holder and/or of the metering and dispensing device cooperate with the connecting parts of the compressed air conduit system to carry the compressed air flow. This achieves a reliably, effective pneumatic sealing system, and creates a device that is not only functionally reliable but is also distinguished by a simple construction and a low number of parts, and that is simple to mount because it is in two parts. Since one part of the device of the invention is removable, filling and cleaning is made substantially easier for the user.

In accordance with an added feature of the invention, the metering and dispensing device is in the form of a rotary drum disposed in a support intended for it in the detergent holder and is equipped with at least one radial indentation, having a cross section which widens to an expulsion opening that is controlled by a movable closure which temporarily closes the applicable indentation during the filling with a dose of detergent. This preferred embodiment of the invention is distinguished in particular by the limitation of the number of parts and by the force required to move the moving parts, which is advantageous with respect to reliability and in terms of overall equipment costs.

In accordance with an additional feature of the invention, the metering and dispensing device has a prismatic shape and at least one indentation and is moved rectilinearly, so that the indentations are brought in alternation into a position that coincides with the outlet opening of the detergent holder, and a closure frontally closes the indentation, which is filled with a dose of detergent. This advantageous embodiment of the invention is also distinguished by a low number of parts and a limitation of the force necessary to move them, which is advantageous for the sake of reliability and of overall equipment costs.

In accordance with yet another feature of the invention, in terms of installation and cleaning, the metering and dispensing device is connectable by insertion to a motion generator by suitable means; and the motion generator is either permanently mounted in a part of the cleaning machine or integrated with the device. Since the parts can be snapped together, the removal of one part of the device of the invention, and therefore filling and cleaning, are further simplified for the user.

In accordance with yet a further feature of the invention, the connecting parts of the holder and/or of the dispensing and metering device and the connecting parts of the compressed air conduit system cooperate by being snapped into one another; and the connecting parts of the compressed air conduit system belong to a system that is permanently built in at some arbitrary point of the cleaning machine, preferably a front door of the cleaning machine; the connecting parts of the detergent holder and/or of the metering and dispensing device are constructed as connection pieces, and the connecting parts of the compressed air conduit system are constructed as openings.

This achieves a reduction in the number of mechanical seals and a further facilitation of installing the device according to the invention. Since the parts can be snapped together, removal of one part of the device according to the invention is made even easier.

In accordance with yet an added feature of the invention, the openings of the compressed air conduit system are essentially blade-shaped, to increase the efficiency of the air flow aimed at the dose of detergent placed in an indentation in the dispensing position. This provides an improvement in the expulsion action caused by the compressed air flow acting upon the interior of the indentations.

In accordance with a concomitant feature of the invention, the compressed air conduit system is equipped with a shutoff valve, which is suitable for preventing a reverse flow of the fluid into the detergent holder, even when a negative pressure prevails in the metering and dispensing device. In this way the penetration of moisture into the detergent holder of the device of the invention is advantageously prevented if negative pressure arises in the device of the invention.

Other features which are considered as characteristic for the invention are set forth in the appended claims.

Although the invention is illustrated and described herein as embodied in a device for repeated, automatic metering of doses of a powdered detergent in water-conducting cleaning machines, in particular household dishwashers and household washing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 3:
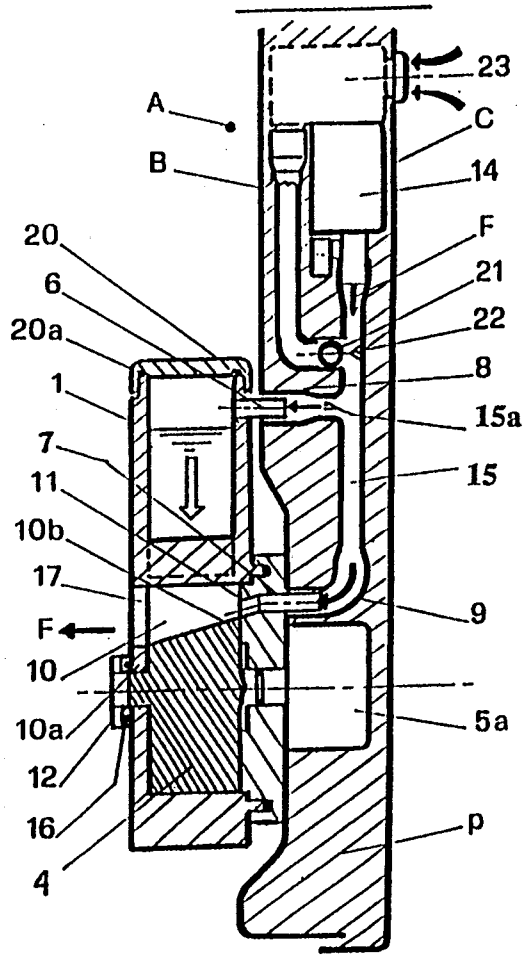
FIG. 3 is a sectional view of the device of the invention, which is taken along the line A—A of FIG. 2, in the direction of the arrows.
Figure 2:
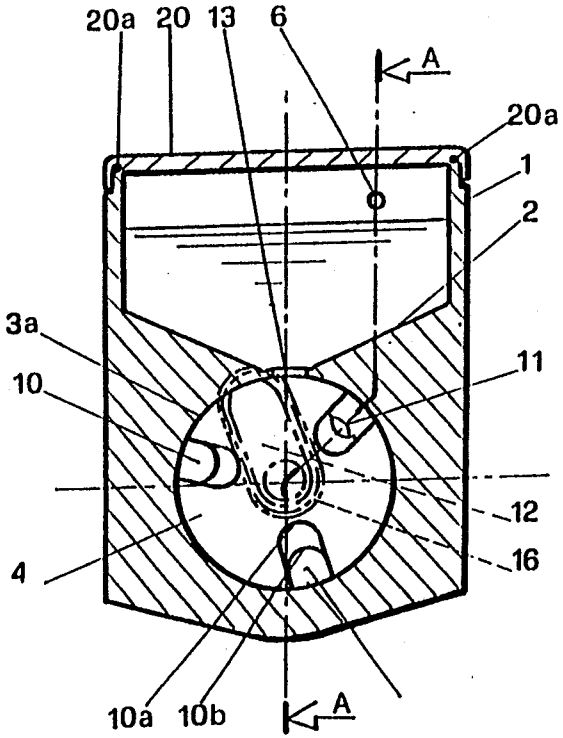
FIG. 2 is a longitudinal-sectional view of the front view of FIG. 1 with a rotated rotary drum.
Figure 1:
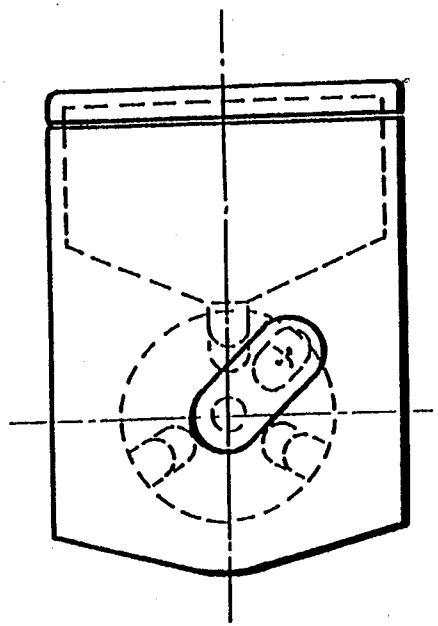
FIG. 1 is a diagrammatic, front-elevational view of a device according to the invention, in a preferred embodiment of the invention, with a metering and dispensing device constructed as a rotary drum.
Figures 4, 4A:
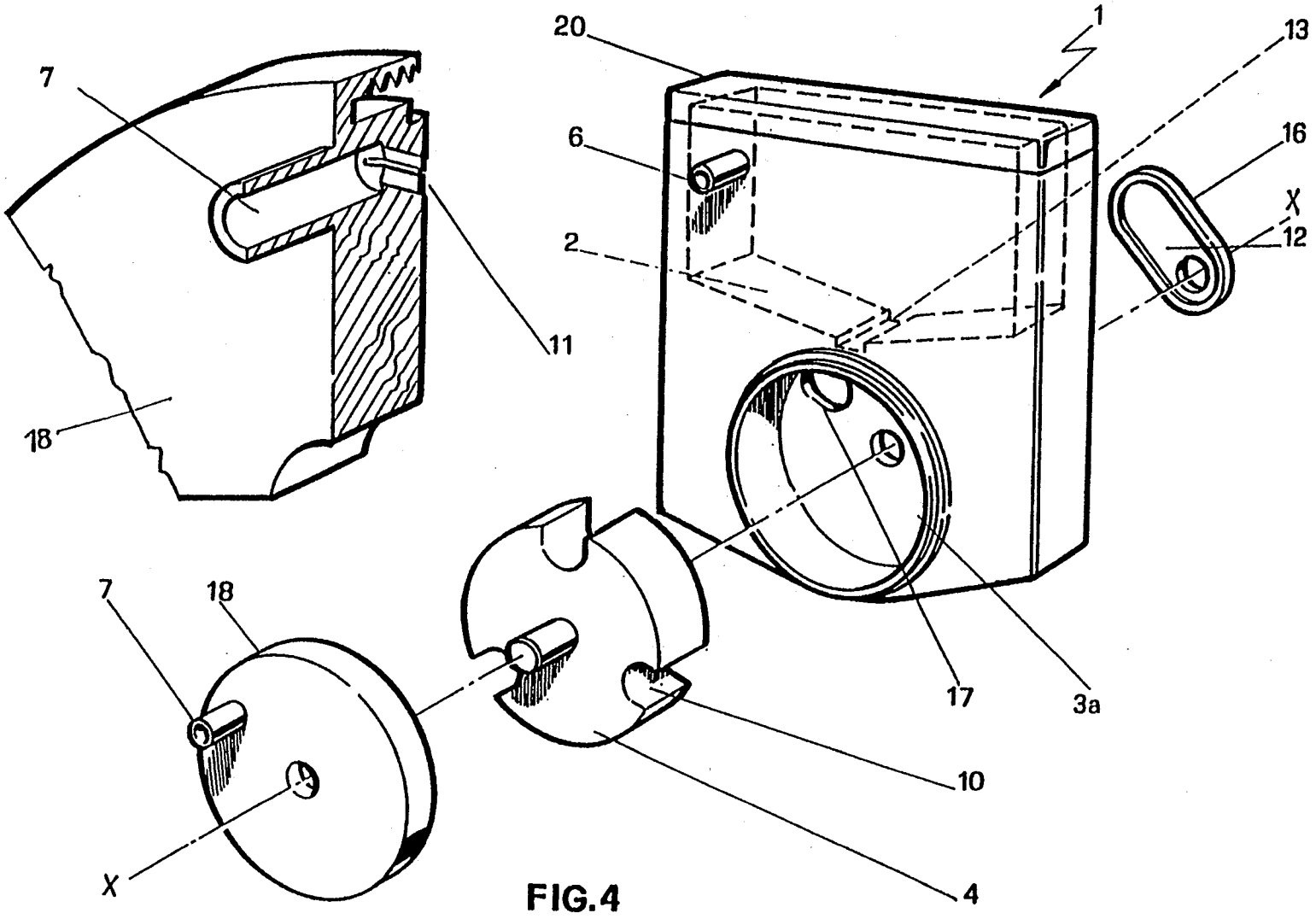
FIG. 4 is an exploded, perspective, axonometric view of individual parts of the device of the invention in the preferred embodiment of FIG. 1.
FIG. 4*a* is an enlarged, fragmentary, perspective view of one connecting part of a compressed air conduit system of the device of the invention.

Referring now to the figures of the drawing in detail and first, particularly, to FIGS. 1–4*a* thereof, there is seen a preferred embodiment of the device of the invention, in which a detergent or cleaning agent holder 2 that has a large capacity or is funnel-like at least in its lower region and that discharges at an outlet opening 13, is molded into a box-like body 1. The detergent holder 2 is closable in water-tight fashion with a removable lid 20, which has a seal 20*a*.

In FIGS. 1–4*a*, a metering and dispensing device with a rotatable drum 4 that is driven by a motion generator in the form of reducing gear 5*a* seen in FIG. 3, is built into the body 1 below the funnel-like holder 2 and its outlet opening 13. The drum 4 is provided in the exemplary embodiment with three radial, frustoconical or frustopyramidal indentations 10 with open cross sections. Larger cross sections 10*a* of the indentations 10 rest on a front inside surface of the box-like body 1, and smaller cross sections 10*b* rest on an opposite parallel surface of the body 1. Rotation of the drum 4 places the larger cross section 10*a* of an indentation 10 into a position facing an expulsion opening 17 formed in the body 1. The expulsion opening 17 discharges into a processing vessel A of a water-conducting or carrying cleaning machine. In the position of the indentation 10 as described, the smaller cross section 10*b* of this indentation faces a mouth 11 of a conduit 15 of a compressed air conduit system. The conduit 15 of the compressed air conduit system is connected to a compressed air generator 14, for instance a diaphragm or some other appliance which is suitable for that purpose. An arm 15*a* branches off from the conduit 15 to supply a compressed air flow F to the interior of the detergent holder 2. Ends of the conduit 15 and the arm 15*a* that face the body 1 form openings, into which connection pieces 6, 7 disposed on the body 1 are inserted. With these connection pieces, rapid connection or disconnection of the body 1 to or from the compressed air system are possible. The connection piece 6 carries the compressed air flow F into the interior of the detergent holder 2. The connection piece 7 carries the compressed air flow F into the interior of the indentation 10 through the smaller cross section 10*a*. The opening 11 of the compressed air conduit system associated with the connection piece 7 has a lamella shape.

Reference numeral 12 indicates a closure, which is set into motion indirectly at an angle by the reducing gear. This closure 12 is provided with a seal 16 and slides into place on a flat outer surface of the body. The motion of the closure 12 is determined in such a way that it closes the fixed outlet opening 17 whenever one of the indentations 10 arrives below the outlet opening 13 of the detergent holder 2 as a result of the rotary motion of the drum 4 and is filled with detergent. The detergent drops by gravity and by air pressure generated by the compressed air generator 14, out of the detergent holder 2 and into the indentation 10 located below it.

Reference numerals 21, 22 indicate a valve, which enables the removal by aspiration of room air or moist air through a dehumidifier 23, when the compressed air generator 14 is at a standstill and/or if negative pressure occurs in the metering and dispensing device. The dehumidifier 23 precedes the compressed air generator 14 and therefore prevents this moist air from penetrating the detergent holder 2.

The compressed air conduit system, including the compressed air generator 14, the conduit 15 and its arm 15*a*, and the reducing gear 5*a*, is preferably built into a door P of the cleaning machine, between an outer wall C and an inner wall B.

When the above-described device is controlled by a program control unit of the cleaning machine, the device functions as follows:

With the cleaning machine running, the closure 12 blocks the expulsion opening 17, so that the water present in the processing vessel A cannot enter the indentations 10. The compressed air generator 14, when set into operation, pumps compressed air that is dehumidified by the dehumidifier 23 into the compressed air conduit system having the conduit 15 and its arm 15*a*. The compressed air flowing into the detergent holder 2 through the arm 15*a* and the connection piece 6 acts upon the detergent. The compressed air delivered through the conduit 15 and the connection piece 7 flows out through the blade-shaped opening 11. If the indentations 10 are in the position shown in FIG. 2, or in other words if none of them are in the filling position, then some of the compressed air, which is always present when the cleaning machine is running, and which is delivered to the space between the drum 4 and a duct 3*a*, prevents the penetration of moisture and/or foreign bodies, which are removed, if present.

The closure 12 is moved about a given angle and uncovers the expulsion opening 17 shown in FIG. 3, whenever an indentation 10 is located between the expulsion opening 17 and the blade-shaped opening 11. As a result, the detergent contained in the indentation 10 can be expelled completely from the indentation 10 by the influence of gravity and by the pressure of the airflow F flowing out of the blade-shaped opening 11 and can reach the processing vessel A of the cleaning machine. This process can be repeated, depending on the cleaning program chosen, until all of the detergent contained in the detergent holder 2 has been completely used up. The detergent holder 2 has a capacity sufficient for a considerable number of cleaning operations.

Figure 6:
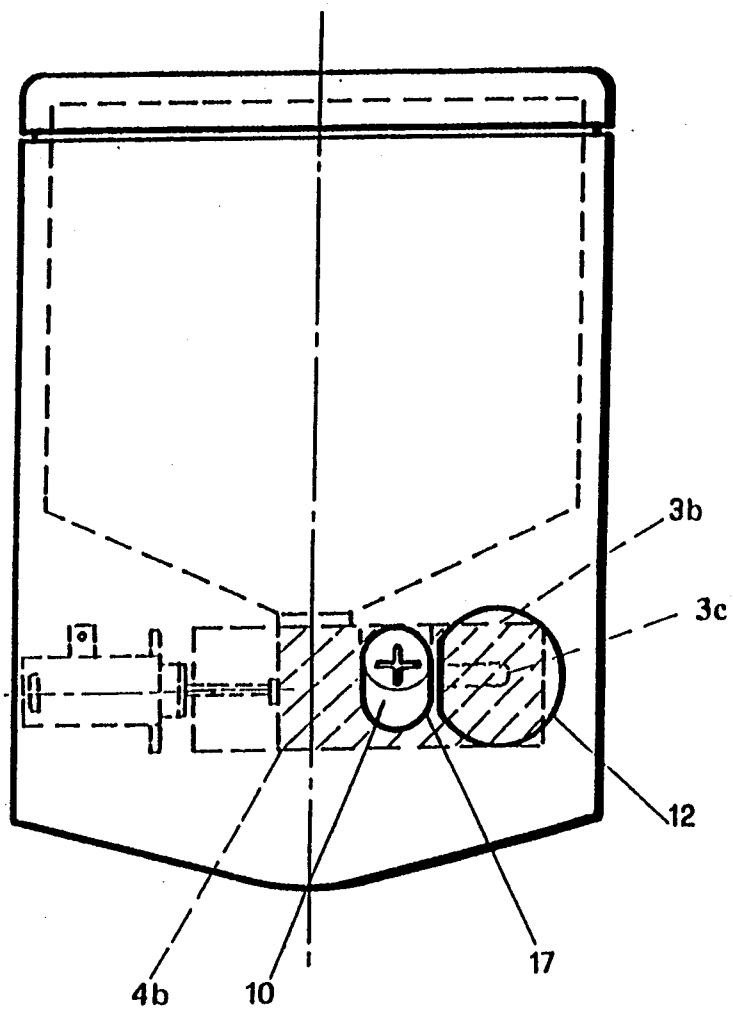
FIG. 6 is a front-elevational view of the further embodiment of the device of the invention of FIG. 5 with the sliding drawer displaced.
Figure 5:
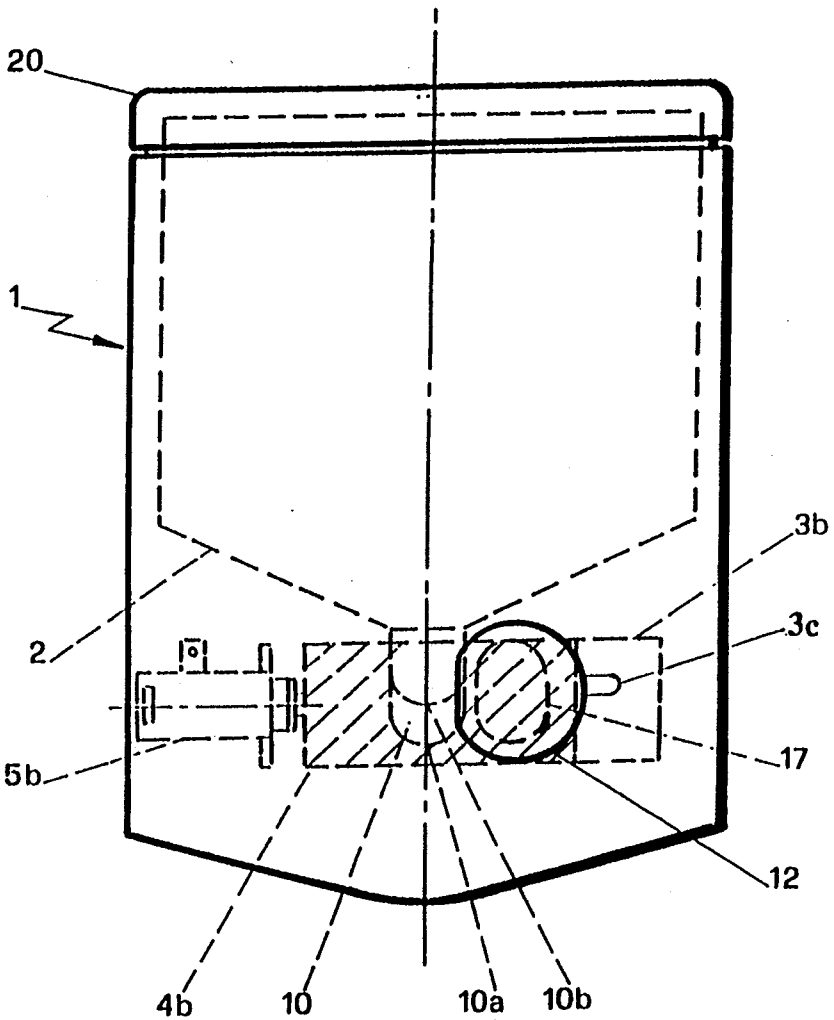
FIG. 5 is an enlarged, front-elevational view of a further embodiment of the device of the invention, with a metering and dispensing device in the form of a sliding drawer.
Figure 7:
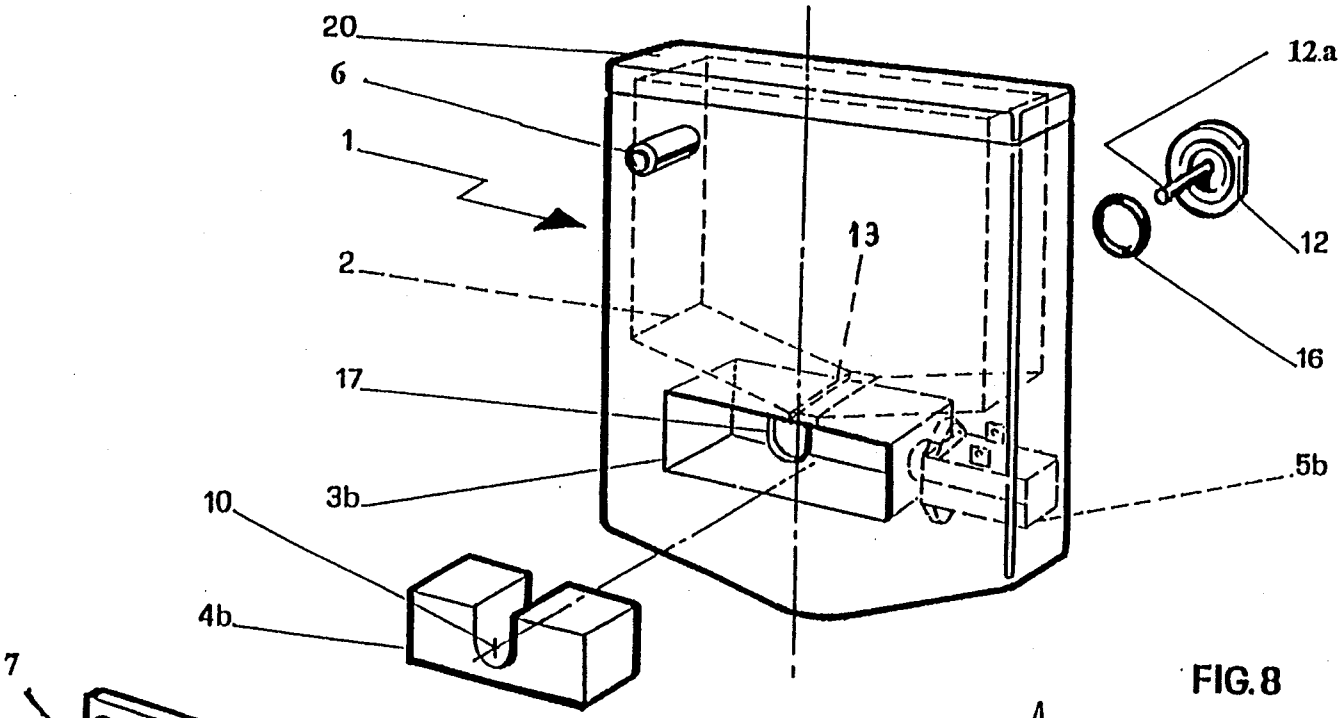
FIG. 7 is an exploded, perspective, axonometric view of individual parts of the further embodiment of the device of the invention shown in FIG. 5.
Figure 8:
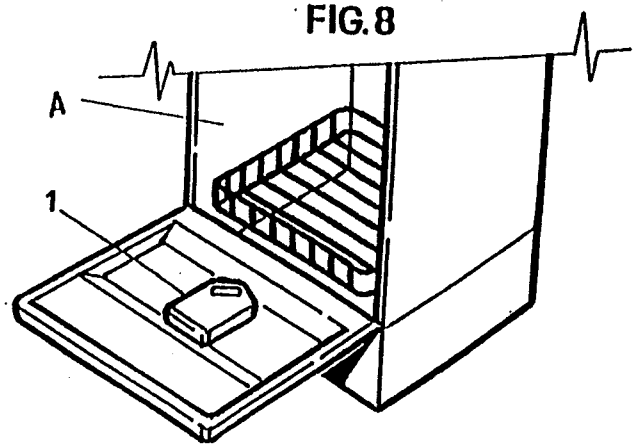
FIG. 8 is a fragmentary, perspective view of a household dishwasher with a door opened and with the device of the invention installed.

In FIGS. 5, 6 and 7, a further embodiment of the device of the invention is shown, in which a metering and dispensing device 4*b* is prismatic in shape and is equipped, in the exemplary embodiment shown, with two indentations 10 that are frustoconical in this example. The shape of the indentations 10 of the metering and dispensing device 4*b* is identical to the shape of the indentations 10 in the drum 4 of the preferred embodiment of the invention described above. In other words, the large cross section of the indentation is oriented toward the expulsion opening 17 disposed in the body 1. The body 1 along with the detergent holder 2 and the compressed air conduit system with the conduit 15 and its arm 15*a*, the compressed air generator 14, the dehumidifier 23 and the outlet openings for the compressed air flow F, all remain unchanged.

The prismatic metering and dispensing device 4*b* is displaceable parallel to the front wall of the body 1 in a suitable duct opposite the expulsion opening 17 of the body 1. The expulsion opening 17 is controlled by a closure 12 having a seal 16 and a pin 12*a* seen in FIG. 7. The closure 12 can be displaced along the duct or slit 13 as is seen in FIGS. 5 and 6. The metering and dispensing device 4*b* is moved alternatingly linearly by a motion generator 5*b*, which is an electric actuator in the embodiment shown. The motion generator 5*b* may also be a thermoactuator or an electromagnet. The motion generator 5*b*, which brings about the alternating motion of the closure 12, is triggered by a cycle or program control unit of the cleaning machine.

Reference numeral 18 indicates a lid for closing the metering and dispensing device 4*b*. The connection piece 7 is disposed on this lid 18. The connection piece 6 is mounted on the body 1. When the connection pieces 6 and 7 are inserted into the corresponding openings of the compressed air conduit system for the compressed air generated by the compressed air generator 14, the compressed air flow F is carried into the detergent holder 2 or into a duct 3*b* and into the metering and dispensing device 4*b*.

It is common to both embodiments that the body 1 can be removed from the cleaning machine for cleaning or to be filled with powdered detergent. Once the body 1 has been put back in place, the cleaning machine can again carry out a certain number of cleaning operations, in which the doses of detergent are constant and are automatically fed into the processing vessel A of the cleaning machine, until the contents of the detergent holder 2 have again been used up.

During one complete cleaning operation, the compressed air generator 14 remains in operation and generates the compressed air flow F, which creates an internal pressure both in the detergent holder 2 and in the metering and dispensing device. The compressed air flow F persistently penetrates every interstice or void and both removes dust particles and foreign bodies and prevents the entry of moisture.

The motion of the device according to the invention is completed in such a way that during a filling situation, the opening of an indentation 10 is opposite the outlet opening 13 of the detergent holder 2, so that the detergent is fed by gravity and by the air pressure being established in the detergent holder 2 from the detergent holder 2 into the indentation 10, and the indentation 10 located under the outlet opening 13 is filled. During this phase, the closure 12 closes the expulsion opening 17. The actuation of the cylindrical metering device 4 or the prismatic metering device **4*b* by the motion generator 5*a* or 5*b* moves the indentation 10, that is then filled with detergent, into the position coinciding with the expulsion opening 17 and simultaneously brings about the displacement of the closure 12, which as a result uncovers the larger cross section 10*a* of the indentation 10 and enables the emergence of the dose of detergent into the processing vessel A, either by its own weight or by the action of the compressed air flowing out of the blade-shaped opening 11. Further positioning of a further indentation 10 so that it is located under the outlet opening 13 of the detergent holder 2 is carried out in synchronism with the motion of the closure 12, which again closes the expulsion opening 17**.

If the compressed air flow F generated by the compressed air generator 14 is interrupted, and/or if a negative pressure is established in the metering and dispensing device, then the valve 21, 22, which for instance is a ball valve built into the compressed air conduit system, prevents the aspiration of moist air from the processing vessel A of the cleaning machine.

The number of doses of detergent that can be dispensed depends directly on the size of the detergent holder 2.

A special feature of the above-described device according to the invention is the pneumatic sealing system, which is provided in particular to prevent penetration of moisture, and which makes conventional seals unnecessary. As a rule, or especially in the presence of powdered, highly abrasive detergent, conventional seals rapidly become plugged.

We claim:

1. In a water-conducting cleaning machine having a processing vessel, a device for repeated, automatic metering of doses of a powdered detergent, comprising:

a detergent holder having an interior and an outlet opening;

a metering and dispensing device disposed below said outlet opening and having at least one indentation with an interior for receiving individual doses of a powdered detergent from said outlet opening and for feeding the individual doses to the processing vessel in a dispensing position thereof;

a duct communicating with said metering and dispensing device;

a compressed air generator connected with said duct and communicating with said metering and dispensing device through said duct, said compressed air generator generating a flow of compressed air continuously acting upon the interior of said detergent holder and acting upon the interior of said indentation in the dispensing position thereof for ejecting the detergent from the interior of said indentation with the compressed air.

2. The device according to claim 1, wherein said metering and dispensing device is a rotary drum, said duct is a support in which said rotary drum is disposed, said at least one indentation is disposed in radial direction of said rotary drum, said rotary drum has a cross section widening to an expulsion opening, and including a movable closure controlling said expulsion opening for temporarily closing said at least one indentation during filling with a dose of detergent.

3. The device according to claim 1, wherein said metering and dispensing device has a prismatic shape and moves rectilinearly for bringing said at least one indentation in alternation into a position coinciding with said outlet opening, and including a closure frontally closing said at least one indentation being filled with a dose of detergent.

4. The device according to claim 1, including a motion generator to which said metering and dispensing device is connected by insertion, said motion generator being permanently mounted in a part of the cleaning machine.

5. The device according to claim 1, including a motion generator to which said metering and dispensing device is connected by insertion, said motion generator being integrated with the metering device.

6. The device according to claim 1, including a compressed air conduit system being connected to said compressed air generator and having connecting parts; said detergent holder being funnel-shaped, having a removable lid water-tightly sealing said detergent holder, and having connecting parts; said metering and dispensing device having connecting parts; and said connecting parts of at least one of said detergent holder and said metering and dispensing device cooperating with said connecting parts of said compressed air conduit system to carry the compressed air flow.

7. The device according to claim 6, wherein said compressed air conduit system has a shutoff valve for preventing a reverse flow of fluid into said detergent holder, even when a negative pressure prevails in said metering and dispensing device.

8. The device according to claim 1, including a dehumidifier connected upstream of said compressed air generator.

9. The device according to claim 8, including a compressed air conduit system being connected to said compressed air generator and having connecting means belonging to a system being permanently built in at a given location of the cleaning machine; said detergent holder and said dispensing and metering device having connecting means; said connecting means of at least one of said detergent holder and said dispensing and metering device and said connecting means of said compressed air conduit system cooperating by being snapped into one another; said connecting means of at least one of said detergent holder and said metering and dispensing device being connection pieces; and said connecting means of said compressed air conduit system being openings.

10. The device according to claim 9, wherein said given location of the cleaning machine is a front door of the cleaning machine.

11. The device according to claim 9, wherein said openings of said compressed air conduit system are substantially blade-shaped for increasing efficiency of the air flow directed at the dose of detergent placed in said at least one indentation in the dispensing position.

12. The device according to claim 9, wherein said compressed air conduit system has a shutoff valve for preventing a reverse flow of fluid into said detergent holder, even when a negative pressure prevails in said metering and dispensing device.

* * * * *